United States Patent [19]

Eyal et al.

[11] Patent Number: 4,974,516

[45] Date of Patent: Dec. 4, 1990

[54] FRAGMENTATION BOMB

[75] Inventors: Joseph Eyal, Ramat Hasharon; Avraham Rosenberg, Holon; Seev W. Zalmon, Haifa, all of Israel

[73] Assignee: State of Israel, Ministry of Defence, Israel Military Industries, Israel

[21] Appl. No.: 4,868

[22] Filed: Jan. 20, 1987

[51] Int. Cl.[5] ..... F42B 12/10

[52] U.S. Cl. ..... 102/476; 102/491; 102/495

[58] Field of Search ..... 102/306–310, 102/476, 491–497

[56] References Cited

U.S. PATENT DOCUMENTS

| | | | |
|---|---|---|---|
| 1,325,706 | 12/1919 | Todisco | 102/495 |
| 2,798,431 | 7/1957 | Semon et al. | 102/495 |
| 3,021,784 | 2/1962 | Meddick | 102/306 X |
| 3,026,802 | 3/1962 | Barnet et al. | 102/467 |
| 3,425,350 | 2/1969 | Zunino et al. | 102/495 |

FOREIGN PATENT DOCUMENTS

| | | | |
|---|---|---|---|
| 76695 | 10/1961 | France | 102/495 |

*Primary Examiner*—Harold J. Tudor

*Attorney, Agent, or Firm*—Steinberg & Raskin

[57] ABSTRACT

A fragmentation projectile such as a single or dual purpose grenade or bomblet for a cargo projectile comprising a fragmentation body enveloping an explosive charge carrying casing, which fragmentation body comprises one or more fragmentation rings notched in axial direction.

Where the grenade is dual purpose, anti-personnel and anti-armor, the explosive charge inside the casing is sealed off by a conical liner.

8 Claims, 2 Drawing Sheets

Fig. 1
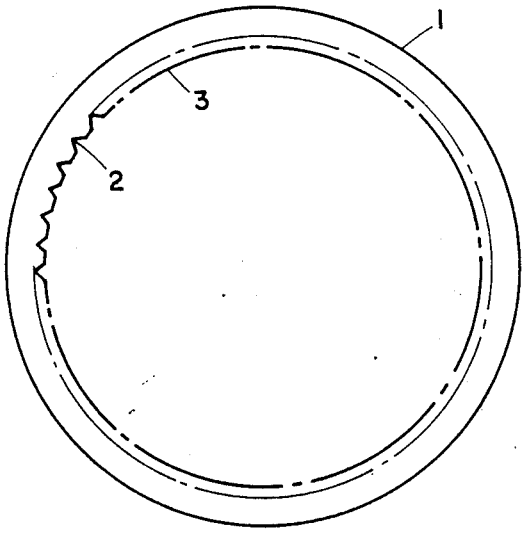
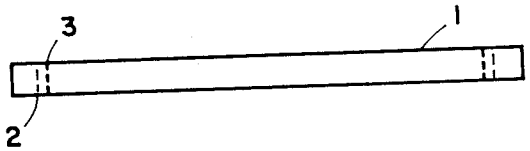
Fig. 2

FRAGMENTATION BOMB

FIELD AND BACKGROUND OF THE INVENTION

The present invention relates to anti-personnel and anti-armour munition such as bombs, grenades and explosive projectiles.

One particular category of such munition is that classified as cargo munition, in which a cargo projectile is utilized to carry and deliver a plurality of grenades, e.g. dual purpose grenades or bomblets serving for anti-personnel and anti-armour purposes. Known grenades of this type comprise a cylindrical body made from a hardened, heat-treated steel. This construction is dictated by the stresses to which the grenade is subject during firing of the cargo projectile and the release and ejection of the grenades therefrom. The invention relates, inter alia, to grenades for cargo projectiles.

In the following description and claims the term "fragmentation grenade" will be used to describe the type of munition with which the invention is concerned, it being understood that such munition is not restricted to grenades proper and comprises also other types of munitions such as bombs, single and dual purpose grenades or bomblets for cargo projectiles, explosive projectiles and the like.

The design of any fragmentation grenade must allow for fragmentation of the body so as to disperse numerous fragments which will maximize the anti-personnel effect in the target area. The fragmentation efficiency of grenades of conventional construction is limited, partially because the above-referred to design criteria which call for a construction which can withstand the firing and ejection stresses, and this is incompatible with design criteria calling for good fragmentation properties. This is true even if the grenade body is pre-stamped with a fragmentation pattern.

It is known that explosive forces released within cylindrical vessels subject the walls to stresses according to principles which dictate that the radial stress is twice that of the longitudinal stress. Therefore the longitudinal fragmentation of such cylindrical bodies, i.e. the tearing open of the body in an axial direction, will not normally occur simultaneously with the radial fragmentation. Thus the fragmentation efficiency and the resulting distribution of fragments is unsatisfactory.

SUMMARY OF THE INVENTION

It is the object of the present invention to provide a new and improved fragmentation grenade of a design such that the above-referred to disadvantages are significantly reduced or overcome.

According to the present invention there is provided a fragmentation grenade comprising:

- a substantially cylindrical casing for carrying a charge of explosive material and having a first, open end and a second, mainly closed end;
- a fragmentation body enveloping said casing and comprising at least one fragmentation ring having a plurality of axially oriented notches, said fragmentation rings being confined between unnotched first and second terminal members, said first terminal member being annular and located near said first end of said casing in a manner that prevents disengagement in a direction away from said second end of the casing, and said second terminal member being located near the second end of said casing;
- means for locking together said second terminal member and casing; and
- means for sealing off said charge of explosive material inside said casing.

Where the fragmentation body comprises two or more fragmentation rings, all of said rings are preferably equiradial. The axial notching of the fragmentation ring(s) may be on the inside or outside edges thereof.

In accordance with one embodiment of the invention the fragmentation grenade is single purpose and the charge of explosive material inside said casing is sealed off by an end plate.

In accordance with another embodiment of the invention, the fragmentation grenade is dual purpose, anti-personnel and anti-armour, and said charge of explosive material inside the casing is designed as a shaped charge by being sealed off by a conical liner which tapers in a direction away from said first end of the casing.

By one feature of the invention, the carrier member end wall and the cover comprise registering central bores accommodating a tubular rivet by which the carrier member and cover are locked together.

If desired, the said tubular rivet may accommodate a booster charge.

BRIEF DESCRIPTION OF THE DRAWINGS

For better understanding the invention will now be described with reference to the attached drawings, in which:

FIG. 1 is a plan view, partly in section, of a pre-notched fragmentation ring used for making a fragmentation grenade in accordance with the invention;

FIG. 2 is an elevation of the ring of FIG. 1;

DESCRIPTION OF A SPECIFIC EMBODIMENT

Figure 3:
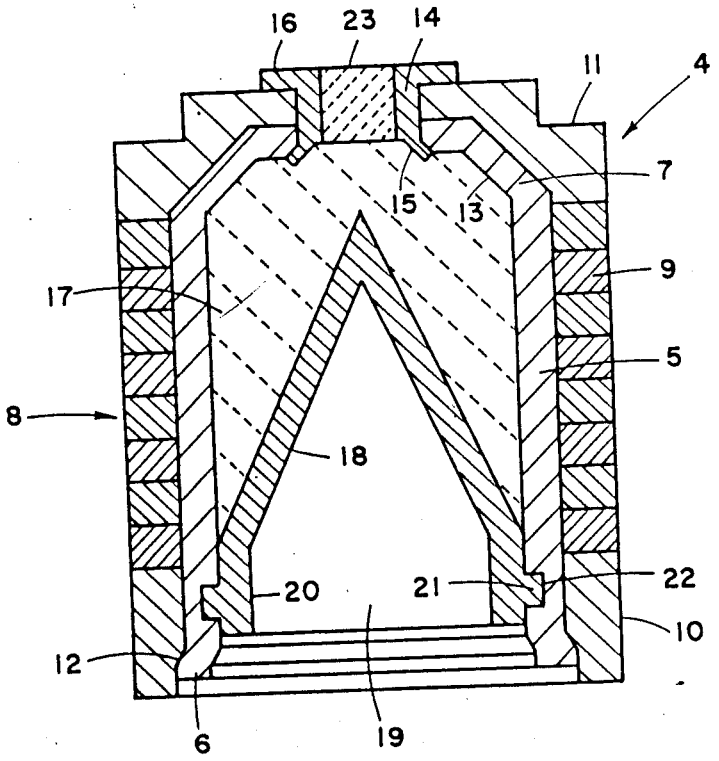
FIG. 3 is an axial section of a dual purpose fragmentation grenade according to the invention.

Referring now to FIGS. 1 and 2, there is shown a metal ring 1 which has a plurality of notches 2 along its inside edge 3. The pre-notching of the ring in the axial direction creates a stress weakness such that radially directed forces cause an extremely high radial fragmentation efficiency.

The dual purpose, anti-personnel and anti-armour fragmentation grenade 4 according to the present invention shown in FIG. 3 comprises a longitudinal casing 5 having a first, open end 6 and a second, closed end 7. Casing 5 is enveloped by a fragmentation body 8 comprising a plurality of notched fragmentation rings 9 of the kind shown in FIGS. 1 and 2, which rings are equiradial and stacked one on top of the other. Rings 9 are confined between first and second unnotched members 10 and 11, the first unnotched member 10 being annular and seated near the first end 6 of casing 5 on an outer circumferential shoulder 12 thereof while the second unnotched member 11 is cap-shaped and seated near the second end 7 of casing 5 on a fluted portion 13 thereof.

The second unnotched member 11 of fragmentation body 8 is tightly secured to casing 5 by a tubular locking rivet 14 engaging registering bores in member 11 and casing 5 and having a fluted skirt 15 and an annular head 16.

The substantially cylindrical casing 5 contains a charge of explosive material 17 sealed off by a conical metal liner 18 forming a tapering interior wall and leaving a cavity 19. A substantially cylindrical end portion 20 of the conical interior liner 18 has an integrally formed circumferential outer rib 21 which mates with an annular groove 22 near the first end of casing 5 whereby liner 18 is retained in position. The explosive charge 17 and liner 18 are thus designed as a shaped charge assembly which, as known per se, produces upon detonation an armour piercing jet in axial direction.

In an alternative embodiment of the invention the explosive charge 17 may fill out substantially the entire inner space of casing 5 and be sealed off by a substantially circular, flat end plate suitably received at the first end of the casing.

For detonation of the explosive charge 17 there is provided a booster charge 23 located in an axial bore of the tubular rivet 13. The booster charge 23 is of a kind known per se and may be in form of an assembly comprising retaining plates and a tightly packed explosive charge. In operation booster charge 23 is detonated by a conventional striker pin/primer mechanism forming part of the grenade head assembly (not shown) mounted on top of member 11 and rivet 14.

Assembly of the fragmentation grenade 4 shown in FIG. 3 may proceed by first connecting casing 5 whose open, first end portion is yet unshaped, to member 11 by means of rivet 14. Thereafter fragmentation rings 9 are mounted on casing 5 and this is followed by mounting the base ring 10. Once the base ring 10 is mounted, the end portion of casing 5 is shaped by rolling so as to form the circumferential groove 21 and the fluted portion thereof to match the internal shoulder 12 of member 10.

After completion of the rolling operation, the booster charge assembly 23 is inserted into the central cavity of rivet 14 and this can be achieved either by using a ready-made booster charge assembly or by assembling it in situ. The central cavity of rivet 14 may be provided with means (not shown) such as a shoulder, for holding the booster charge assembly 23 in position.

At this point, the fragmentation grenade is inverted and explosive charge 17 is poured into casing 5. The conical interior liner 18 is then inserted and a pressure operation is performed on the substantially cylindrical end portion 20 of liner 18 to integrally form a circumferential outer rib 21 which locks it into the annular groove 22 of casing 5.

From the foregoing description it is readily understood that the fragmentation grenade according to the invention excels by a high, reliable and reproducable fragmentation efficiency in both radial and axial directions. The radial fragmentation is facilitated by the notched design of each of the fragmentation rings that constitute the grenade body; and where two or more such rings are provided axial fragmentation is predetermined and requires very little energy by the very fact that the grenade body is constituted by a plurality of discrete rings.

Although particular embodiments of the invention have been described and illustrated herein, it is recognized that modifications and variations may readily occur to those skilled in the art. In particular it should be noted that instead of using fragmentation rings that are notched on the inside edge, it is also possible in accordance with the invention to use rings that are notched on the outside edge or even on both sides.

We claim:

1. A dual purpose, anti-personnel and anti-armor fragmentation grenade being of a cargo munition type, and comprising:

a substantially cylindrical casing or carrying a charge of explosive material and having a first, open end and a second, mainly closed end, a fragmentation body enveloping said casing and comprising at least two equi-radial fragmentation rings each having a plurality of axially oriented notches on an inside edge thereof, said fragmentation rings being confined between unnotched first and second terminal members, said terminal member being annular and located near said first end of said casing in a manner that prevents disengagement in a direction away from said second end of said casing, and said second terminal member being located near said second end of said casing;

means for locking together said second terminal member and casing: and a conical liner tapering in a direction away from said first open end of said casing, for sealing off said charge of explosive material inside said casing, whereby a shaped explosive charge is formed.

2. The grenade of claim 1, wherein said second, closed end of said casing is fluted, and said second unnotched member is cap-shaped.

3. The grenade of claim 1, wherein said casing comprises an annular groove situated near said first open end thereof, and said liner comprises an integrally-formed, outer circumferential rib situated to mate with said annular groove, whereby said liner is retained in position.

4. The grenade of claim 1, being structured to provide for simultaneous radial and axial fragmentation thereof, upon detonation.

5. The grenade of claim 1, wherein said discrete rings are solely confined by said terminal members, and are not integrally attached to one another.

6. A fragmentation grenade according to claim 1, wherein said locking means comprise said second notched member of the fragmentation body being linked to said second end of the casing by a tubular rivet engaging registering bores of said second unnotched member and casing.

7. A fragmentation grenade according to claim 6, wherein said rivet accommodates a booster charge.

8. A grenade of claim 6, wherein said rivet comprises a fluted skirt and an annular head.

* * * * *